US006389619B1

(12) United States Patent
Dunn

(10) Patent No.: US 6,389,619 B1
(45) Date of Patent: May 21, 2002

(54) INVALID LIFTING DEVICE

(75) Inventor: Robert Dunn, Cheltenham (GB)

(73) Assignee: Arjo Limited, Gloucestershire (GB)

( * ) Notice: Subject to any disclaimer, the term of this patent is extended or adjusted under 35 U.S.C. 154(b) by 0 days.

(21) Appl. No.: 09/496,592

(22) Filed: Feb. 2, 2000

(30) Foreign Application Priority Data

Feb. 5, 1999 (GB) ..... 9902466

(51) Int. Cl.[7] ..... A61G 7/10; A61G 7/12
(52) U.S. Cl. ..... 5/86.1; 5/81.1 R
(58) Field of Search ..... 5/86.1, 83.1, 81.1 R, 5/89.1

(56) References Cited

U.S. PATENT DOCUMENTS 4,569,094 A 2/1986 Hart et al. ..... 5/86.1
6,119,287 A * 9/2000 Phillips ..... 5/86.1
6,134,725 A * 10/2000 Bouhuijs ..... 5/86.1

FOREIGN PATENT DOCUMENTS

WO WO 96/11658 4/1996
WO WO 96/28125 9/1996

* cited by examiner

*Primary Examiner*—Alexander Grosz
(74) *Attorney, Agent, or Firm*—Young & Thompson

(57) ABSTRACT

An invalid lifting device includes a mobile chassis, a lifting mechanism and a sling connectible to the arm supports to assist in raising a seated person to a standing or substantially standing position. The lifting mechanism includes a lifting arm and an actuator device operative to raise and lower the lifting arm. The lifting arm is pivotable about first and second horizontal axes, the first horizontal axis being fixed and being further from the arm supports than the second horizontal axis. The lifting mechanism also includes guiding elements defining a guide path along which the second horizontal axis is caused to move as the actuating device raises and lowers the lifting arm.

17 Claims, 3 Drawing Sheets

INVALID LIFTING DEVICE

INTRODUCTION

This invention relates to an invalid lifting device and more particularly to such a device for lifting an invalid from a seated to a substantially standing position, especially but not exclusively as part of a toileting procedure.

Lifting devices for lifting an invalid (which term includes infirm, disabled and elderly persons) from a seated to a standing position nowadays generally make use of a sling which is passed around the back and below the armpits of the invalid. The sling is attached to two laterally spaced sling attachment points on a lifting arm which is pivoted, typically by a motor driven linear actuator, relative to a mast upstanding from a mobile chassis to raise the shoulders of the invalid along a generally arcuate path.

SUMMARY OF THE INVENTION

According to the present invention there is provided an invalid lifting device comprising a mobile chassis, a lifting mechanism and a sling connectible to the lifting mechanism to at least assist in raising a seated person to a standing or substantially standing position, wherein the lifting mechanism comprises a lifting arm, an actuating device operative to raise and lower the lifting arm, the lifting arm being pivotable about first and second horizontal axes, the first horizontal axis being substantially fixed and being further from a projecting end of the lifting arm than the second horizontal axis, and means defining a guide path along which the second horizontal axis is caused to move as the actuating device raises and lowers the lifting arm.

Preferably, the guide path is generally upwardly inclined in an in use direction away from the person being lifted. In one embodiment, the guide path may be a rectilinear guide path. This has the effect of flattening out the arc through which the end of the lifting arm distal from the horizontal axes would otherwise pivot to thereby mimic the way in which a person stands when lifting himself from a seated position using downward pressure of his hands on the armrests of a chair. Alternatively, the guide path could be a curved guide path and, in this case, it could be an S-shaped or substantially S-shaped guide path so that the person being lifted can be initially moved generally forwards and then moved generally upwards.

Preferably, the lifting device further comprises arm supporting means for supporting the arms of a person to be lifted, the arm supporting means including at least one hand grip. In this case, preferably, the lifting mechanism comprises two arms which are pivotably connected to the arm supporting means. These two arms could form a parallelogram linkage, but are preferably arranged so as to move the arm supporting means from a position in which it is upwardly inclined in an in use direction away from a person to be lifted to, or towards, a position in which it is substantially horizontal as the arm supporting means is raised by the lifting mechanism. This has the advantage that the lifting mechanism can raise and lower a taller person to a standing or substantially standing position than would otherwise be the case with lifting arms of the same length.

Preferably, the invalid lifting device further comprises at least one footrest and knee abutment means above the at least one footrest to support the knees of a person being lifted. The knee abutment means may be mounted for pivotable movement from a vertical or substantially vertical position to an upwardly inclined position in an in use direction away from the person to be lifted against the urging force of spring means. This allows the knees of the patient to move slightly forwards as the patient is lifted, the spring means urging the knee abutment means and the knees of the person being lifted rearwards as the person reaches a standing or substantially standing position.

The knee abutment means and the at least one footrest may be removably supported by the chassis. With the footrest or footrests removed, the lifting device can be used as a rehabilitation aid.

Preferably, the arm supporting means comprises two arm supports. These may be mounted on an inverted U-shaped bracket which is supported by the lifting mechanism. An adjustable strap may be provided between the free ends of the arms of the inverted bracket to prevent a person falling into the bracket. Each arm support is preferably generally L-shaped to support the forearms and at least part of the upper arms of a person to be lifted. In this case, the position of the hand grips may be adjustable so that the elbow of the person to be lifted can rest in contact with the junction between the two limbs of the generally L-shaped arm supports. The arm supports may be provided with releasable straps for holding a person's arms firmly in place in the arm supports. The arm supports may be shaped to cradle the person's arms.

Advantageously, the lifting sling has a cord at each end and the inverted U-shaped bracket is provided with two jamb cleats for receiving the two cords, respectively. This allows the effective length of the sling to be adjusted.

Preferably, the lifting device further comprises a support structure upstanding from the chassis, the means defining the guide path being supported between the chassis and the support structure. In this case the support structure may also support means defining said first horizontal axis. The support structure may also support a handle by which an attendant can wheel the lifting device along the floor.

The invention will now be more particularly described, by way of example, with reference to the accompanying drawings.

DESCRIPTION OF THE PREFERRED EMBODIMENT

Figure 1A:
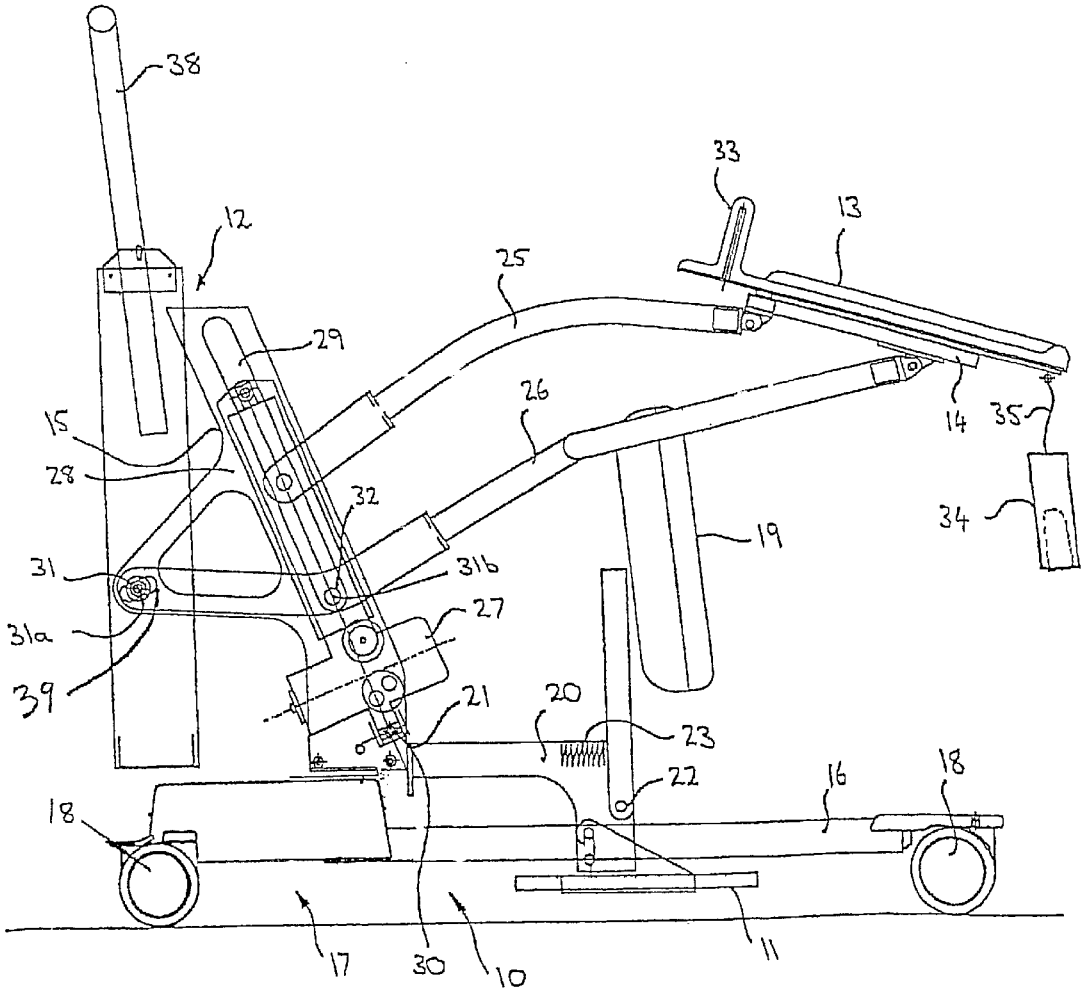
FIG. 1*a* is a side view of a first embodiment of an invalid lifting device, in a first position, according to the present invention.
Figure 1B:
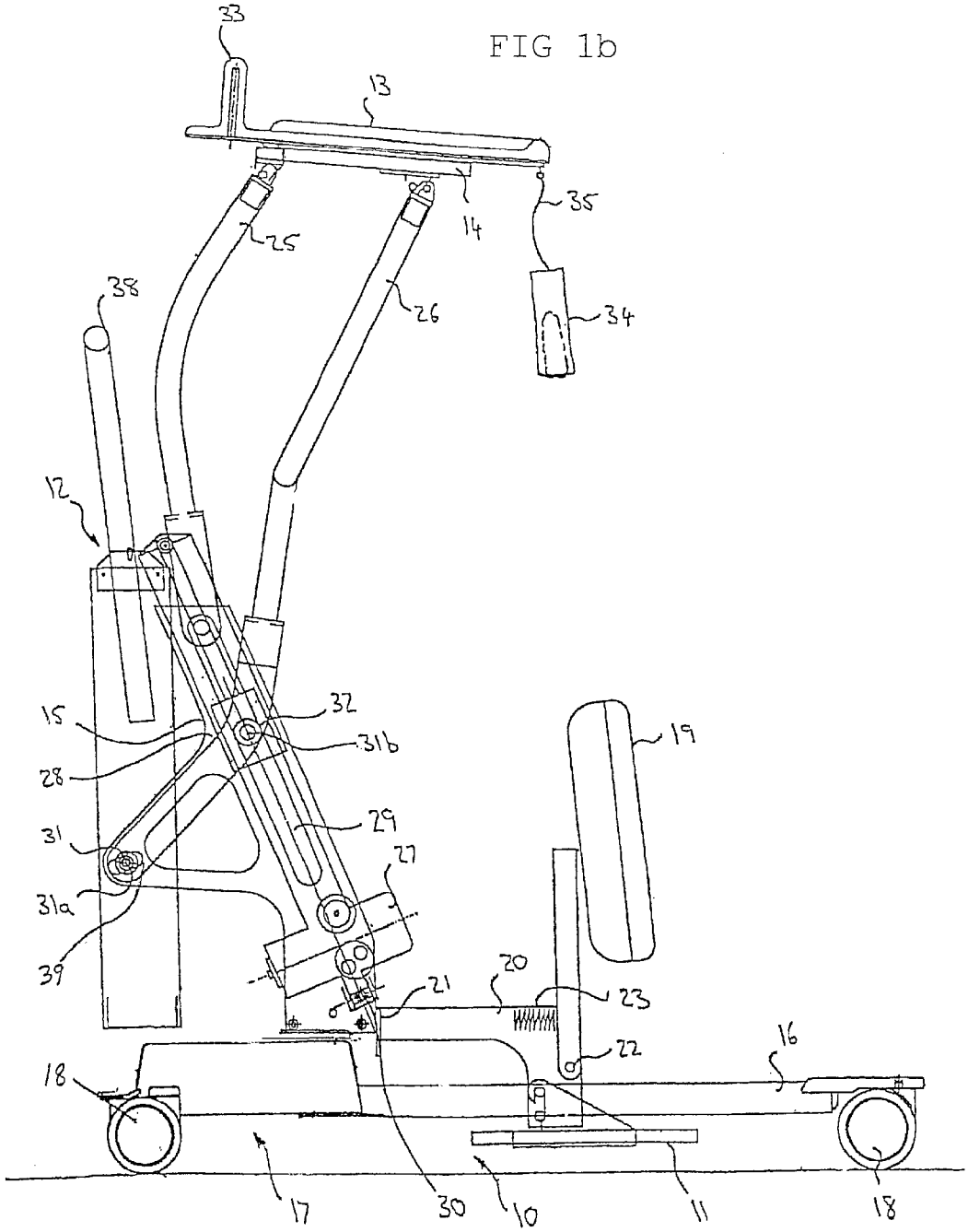
FIG. 1*b* is a side view of the first embodiment, in a second position.

Referring firstly to FIG. 1 of the drawings, the invalid lifting device shown therein comprises a mobile chassis 10, a footrest 11, a support structure 12 upstanding from the chassis 10, two arm supports 13 mounted on an inverted U-shaped bracket 14 and a lifting mechanism 15 for raising and lowering the arm supports 13.

The chassis 10 comprises two legs 16 and a cross member 17. The legs 16 are provided with castors 18 at opposite ends and are pivotable relative to the cross member 17 from a position as shown and in which they are in parallel spaced relationship to a position in which they diverge towards their free ends.

Two knee abutments 19 are supported by arms 20 which are detachably connected to a bracket 21 mounted on the chassis 10. The knee abutments 19 are pivotably connected to the arms 20 about a horizontal axis 22 and are urged into a vertical or substantially vertical position (as shown in FIG. 1) by compression springs 23. The footrest 11 is detachably connected to the arms 20. The footrest 11 can be removed on its own or the footrest 11 and the knee abutments 19 can be removed so that the lifting device can be used as a rehabilitation aid.

The lifting mechanism 15 comprises two lifting arms 25 and 26, a power driven linear actuator 27, typically a motor driven hydraulic actuator of the type made and sold by Smiths Industries Limited as a Single Acting Electrohydraulic Actuator 102740, and two spaced apart guide plates 28.

The guide plates 28 are secured between the chassis 10 and an upper end of the support structure 12. Each guide plate 28 has an elongate guide slot 29. In the embodiment shown, these are rectilinear slots, but they could be curved or S-shaped slots. The slots 29 are upwardly inclined in a direction away from a person to be lifted.

The actuator 27 is pivotably connected at its lower end about a horizontal axis 30 between the two guide plates 28.

The lower lifting arm 26 is bifurcated at its projecting end where it is pivotably connected to the bracket 14 and is pivotably connected at horizontal axis 31*a* at its other end about a pivot pin 31 supported by the upstanding support structure 12. The lower lifting arm 26 is also pivotably connected at horizontal axis 31*b* to the extendible part of the actuator 27 and has two rollers 32 which are located in the two guide slots 29, respectively. The upper lifting arm 25 is pivotably connected at its projecting end to the bracket 14 and at its other end to the extendible part of the actuator 27.

It will be appreciated that as the lower lifting arm 26 is pivotably connected about both the pin 31 and to the extendible part of the actuator 27, there has to be some provision for limited movement of this lifting arm 26 relative to one of these two pivots. This limited movement is provided relative to the pivot pin 31 by an elongate slot 39 in the lower lifting arm 26 for receiving the pivot pin 31.

Pivoting the lower lifting arm 26 about the extendible part of the actuator 27 as well as about the pivot pin 31 and guiding the rollers 32 along the guide slots 29 has the effect of flattening out the arc through which the outer end of the lifting arm 26 would otherwise pivot if it was pivoted only about the pivot pin 31. The bracket 14 is thus raised along what approximates to a rectilinear path to thereby closely mimic the way in which a person stands when lifting himself from a seated position using downward pressure of his hands on the armrest of a chair. This is in contrast to the hitherto known practice of lifting a person along an arcuate path and is considered to provide a more comfortable lift.

The two arms 25 and 26 could form a parallelogram linkage between the actuator 27 and the bracket 14, but are preferably arranged to move the bracket 14 and thereby the arm supports 13 from a position in which they are upwardly inclined in an in use direction away from a person to be lifted to, or towards, a position in which they are substantially horizontal as the brackets 14 and arm supports 13 are raised by the lifting mechanism 15. This is achieved by spacing the pivotable connections between the two arms 25 and 26 and the bracket 14 closer together than the pivotable connections between the two arms 25 and 26 and the actuator 27 and has the advantage that the lifting device can raise and lower a taller person to a standing or substantially standing position than would otherwise be the case with lifting arms of the same length.

The arm supports 13 are generally L-shaped to support the forearms and at least part of the upper arms of a person to be lifted. Each arm support is provided with a hand grip 33 and a position of each hand grip 33 may be adjustable so that the elbow of the person to be lifted can rest in contact with the junction between the two limbs of the generally L-shaped arm supports 13. The arm supports 13 are shaped to cradle the persons arms and are padded to give added comfort.

Releasable straps (not shown), typically having hook and loop fastening means, may be provided on the arm supports 13 to hold the arms of the person firmly in place.

A sling 34 is also provided. The sling 34 is made of a woven fabric material and a central part of the sling 34 may be padded for comfort. The sling 34 has a cord 35 at each end and the bracket 14 is provided with two jamb cleats 36 (shown in FIG. 2) for receiving the two cords 35, respectively. This allows an effective length of the sling 34 to be adjusted.

An adjustable strap (not shown) is provided between the free ends of the arms of the bracket 14 to prevent a person to be lifted falling into the bracket 14.

A handle 38 is provided at the upper end of the support structure 12 to allow an attendant to wheel the lifting device over a floor.

In use, the lifting device is presented to a seated person with the legs 16 of the chassis 10 straddling a chair on which a person to be lifted is seated. The person places his/her feet on the footrest 11 with his/her knees against the knee abutments 19. The person then places his/her arms in the arm supports 13 and takes hold of the hand grips 33. The releasable straps (if provided) can then be secured in place around the arms by a nurse or other attendant. The sling 34 is then placed around the lower back of the seated person and connected to the jamb cleats 36. The arm supports 13 are then raised. As the person is raised, the knee abutments 19 pivot against the urging force of the springs 23 so that the knees of the patient move slightly forwards. As the person reaches a standing or substantially standing position, the springs 23 urge the knee abutments 19 and the knees of the person being lifted rearwards.

The arm supports 13 provide control of the upper body for the person and prevent the person swaying from side to side.

If the lifting device is to be used as a rehabilitation aid to help a person practice walking, the footrest 11 is removed before the patient is lifted. When the person has been lifted to a standing position, the knee abutments 19 are also removed to create clearance for the patient to walk.

Figure 2:
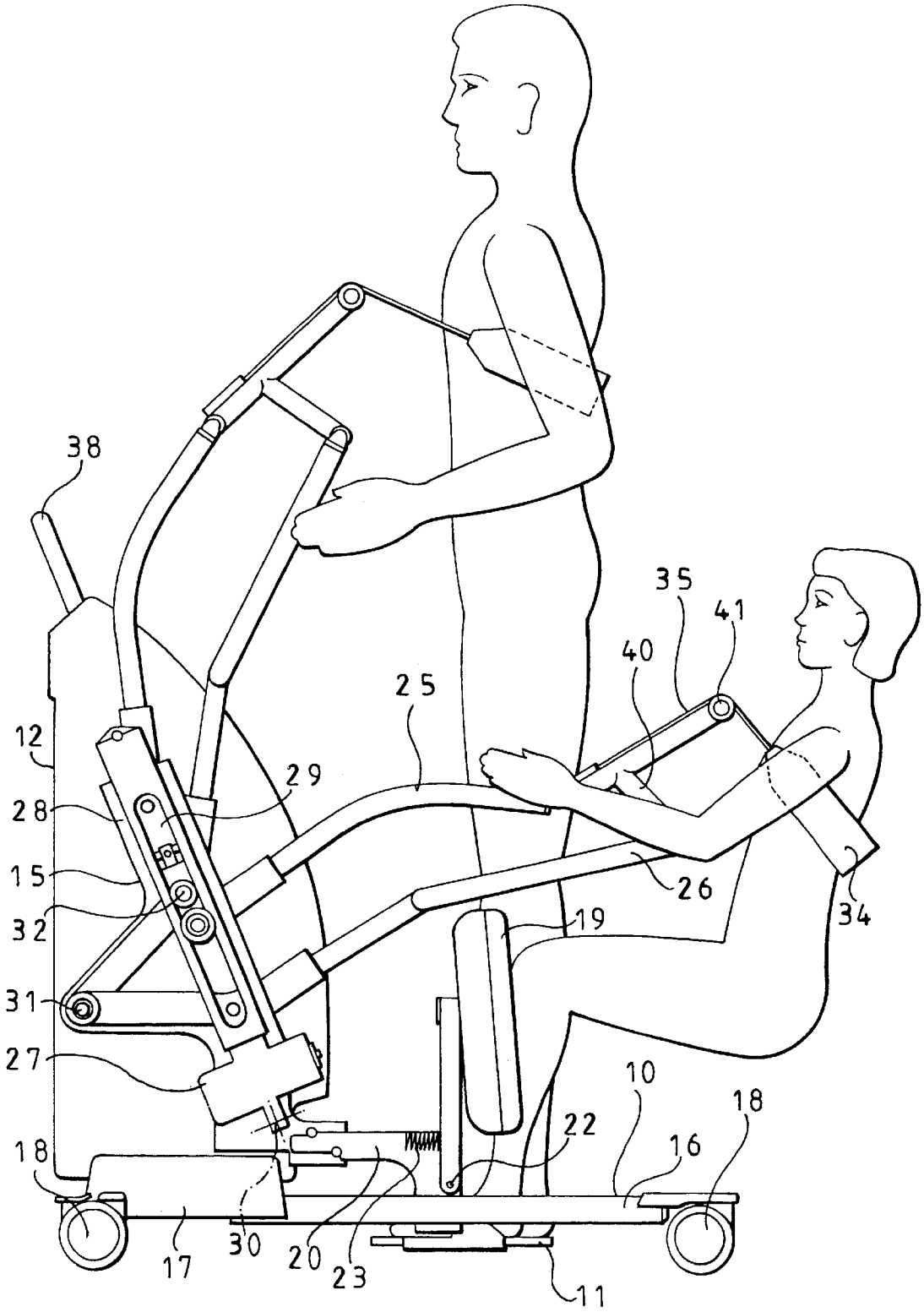
FIG. 2 is a side view of another embodiment of an invalid lifting device according to the present invention.

Referring now to FIG. 2 of the drawings, the lifting device shown therein differs from the device shown in FIG. 1 in that the arm supports 13 and bracket 14 have been replaced by a sling support 40 which is pivotably connected to both the upper and lower arms 25 and 26. The sling support 40 has two laterally spaced apart sling attachment points 41 for supporting the sling 34 passing around the back and below the armpits of the person to be lifted. In this case, the person is supported solely by the sling 34.

The above embodiments are given by way of example only and various modifications will be apparent to a person skilled in the art without departing from the scope of the invention. For example, as stated previously, the guide slots 29 need not be rectilinear, but could be curvilinear and, indeed, S-shaped. In this case, the slots 29 could be so arranged that the person being lifted is initially moved in a generally forwards direction and then in a generally upwards direction.

What is claimed is:

1. An invalid lifting device comprising:

a mobile chassis (10);

a lifting mechanism (15); and a sling (34) connectible to the lifting mechanism (15) to at least assist in raising a seated person to a standing or substantially standing position, wherein the lifting mechanism (15) comprises:

a lifting arm (26);

an actuating device (27) operative to raise and lower the lifting arm (26), the lifting arm (26) being pivotable about first and second horizontal axes (31*a* and 31*b*), the first horizontal axis (31*a*)being substantially fixed and being further from a projecting end of the lifting arm (26) than the second horizontal axis (31*b*);

and means (28, 29) defining a guide path along which the second horizontal axis (31*b*) is caused to move as the actuating device (27) raises and lowers the lifting arm (26).

2. An invalid lifting device as claimed in claim 1, wherein the guide path is generally upwardly inclined in an in use direction away from the person being lifted.

3. An invalid lifting device as claimed in claim 2, wherein the guide path is rectilinear guide path.

4. An invalid lifting device as claimed in claim 1, wherein the lifting device further comprises means (13, 14) for supporting the arms of a person to be lifted, the arm supporting means including at least one hand grip (33).

5. An invalid lifting device as claimed in claim 4, wherein the lifting mechanism (15) comprises two arms (25, 26) which are pivotably connected to the arm supporting means (13, 14).

6. An invalid lifting device as claimed in claim 5, wherein the two arms (25, 26) are arranged so as to move the arm supporting means (13, 14) from a position in which it is upwardly inclined in an in use direction away from a person to be lifted to, or towards, a position in which it is substantially horizontal as the arm supporting means (13, 14) is raised by the lifting mechanism (15).

7. An invalid lifting device as claimed in claim 4, wherein the arm supporting means (13, 14) comprises two arm supports (13) each provided with a hand grip (33).

8. An invalid lifting device as claimed in claim 7, wherein the arm supports (13) are mounted on an inverted U-shaped bracket (14) which is supported by the lifting mechanism (15).

9. An invalid lifting device as claimed in claim 8, wherein the lifting sling (34) has a cord (35) at each end and the inverted U-shaped bracket is provided with two jamb cleats (36) for receiving the two cords, respectively.

10. An invalid lifting device as claimed in claim 7, wherein each arm support (13) is generally L-shaped to support the forearms and at least part of the upper arms of a person to be lifted.

11. An invalid lifting device as claimed in claim 10, wherein the position of the hand grips (33) is adjustable so that the elbow of the person to be lifted can rest in contact with a junction between the two limbs of the generally L-shaped arm supports (13).

12. An invalid lifting device as claimed in claim 7, wherein the arm supports (13) are shaped to cradle the person's arms.

13. An invalid lifting device as claimed in claim 1, further comprising at least one footrest (11) and knee abutment means (19, 20, 21) above the at least one footrest (11) to support the knees of a person being lifted.

14. An invalid lifting device as claimed in claim 13, wherein the knee abutment means (19, 20, 21) is mounted for pivotable movement from a vertical or substantially vertical position to an upwardly inclined position in an in use direction away from a person to be lifted against the urging force of spring means (23).

15. An invalid lifting device as claimed in claim 13, wherein the knee abutment means (19) and the at least one footrest (11) are removably supported by the chassis (10).

16. An invalid lifting device as claimed in claim 1, further comprising a support structure (12) upstanding from the chassis (10), the means (28, 29) defining the guide path being supported between the chassis (10) and the support structure (12).

17. An invalid lifting device as claimed in claim 16, wherein the support structure (12) supports means (31) defining said first horizontal axis (31*a*).

* * * * *